United States Patent [19]

Graham

[11] 4,343,865

[45] Aug. 10, 1982

[54] HARD METAL BODY AND METHOD OF MAKING SAME

[75] Inventor: Donald E. Graham, St. Clair Shores, Mich.

[73] Assignee: General Electric Company, Columbus, Ohio

[21] Appl. No.: 276,918

[22] Filed: Jun. 24, 1981

[51] Int. Cl.[3] ..... B22F 7/02; C23C 11/02

[52] U.S. Cl. ..... 428/552; 428/627; 75/238

[58] Field of Search ..... 428/551, 552, 555, 627, 428/698; 75/202, 238, 203; 427/249, 255.7; 148/6.3

[56] References Cited

U.S. PATENT DOCUMENTS

| | | | |
|---|---|---|---|
| 3,647,576 | 3/1972 | Yamamura | 75/202 |
| 3,668,017 | 6/1972 | Mandineau | 148/6.3 |
| 3,684,585 | 8/1972 | Stroup | 427/249 |
| 3,784,402 | 1/1974 | Reedy | 148/6.3 |
| 4,236,926 | 12/1980 | Lindholm | 75/202 |
| 4,237,184 | 12/1980 | Gonseth | 148/6.3 |
| 4,239,536 | 12/1980 | Yamamoto | 75/202 |
| 4,268,582 | 5/1981 | Hale | 75/202 |

FOREIGN PATENT DOCUMENTS 55-154559 12/1980 Japan .
55-154560 12/1980 Japan .
55-154562 12/1980 Japan .

OTHER PUBLICATIONS

"Articles Coated with Boron and a Metallic Diboride", Ducrot et al., Chemical Abstracts, vol. 80, 1974, 73542g.

*Primary Examiner*—L. Dewayne Rutledge
*Assistant Examiner*—J. J. Zimmerman
*Attorney, Agent, or Firm*—Hedman, Casella, Gibson & Costigan

[57] ABSTRACT

A multi-layered wear resistant article and a method for forming the same is disclosed which is adapted for use with cutting tools. More particularly, the article includes a substrate formed from a cemented sintered metal carbide material such as a tungsten carbide and cobalt composition. A bonding layer formed of elemental boron is provided to increase the adhesion between the substrate and an outer coating of a wear resistant material such as titanium boride. A thin intermediate layer of titanium carbide, titanium nitride, titanium carbonitride, hafnium carbide, hafnium nitride, hafnium carbonitride, zirconium carbide, zirconium nitride, zirconium carbonitride, or a mixture of any of the foregoing may be interposed between the boron adhesive layer and the substrate to prevent diffusion of boron from the bonding layer into the substrate.

8 Claims, No Drawings

HARD METAL BODY AND METHOD OF MAKING SAME

BACKGROUND OF THE INVENTION

The subject invention relates to the production of sintered hard metal bodies adapted for use in cutting tools that are utilized in highly abrasive applications such as metal cutting and rock drilling. More specifically, the subject invention provides for a new and improved multi-layered hard metal body with improved adhesion between the layers.

In the prior art, a variety of hard metal bodies consisting essentially of cemented carbide materials have been utilized in the formation of cutting tools and cutting inserts. In many applications, it is desirable to provide the cutting tool with an outer coating of a highly wear resistant compound to increase the abrasion resistance of the tool. For example, known cutting tools formed from cemented carbide materials have been provided with an outer layer of titanium boride for increasing wear resistance. The resultant increase in abrasion resistance of the cutting tool is in part a function of the adhesion developed between the substrate and the outer wear resistant coating. Accordingly, it is desirable to maximize the adhesion between the substrate and the wear resistant coating material in order to maximize the abrasion resistance of the tool.

In the prior art, various methods have been used in order to increase the adhesion between the substrate and the wear resistant outer coating. One approach is described in T. E. Hale and R. C. Lueth, U.S. Pat. No. 4,268,582, assigned to the same assignee as the subject invention, which relates to the coating of a wear resistant titanium boride layer over a cemented carbide substrate formed from a combination of tungsten carbide and cobalt. In the latter method, silicon, aluminum or boron is initially diffused into the uncoated substrate. An intermediate layer, having a thickness less than 10 microns is then deposited on the treated substrate. The intermediate layer is formed from a combination of titanium carbide and titanium nitride. Thereafter, a thicker layer, of approximately 5 to 20 microns in depth, of the wear resistant titanium boride is deposited over the intermediate layer. While the above disclosed prior art method produced a hard metal body having improved adhesion between the layers, it would be desirable to provide a new and improved hard metal body with even greater resistance to abrasion.

Accordingly, it is an object of the subject invention to provide a new and improved multi-layered hard metal body adapted for use with cutting tools having improved adhesion between the layers.

It is another object of the subject invention to provide a new and improved hard metal body for cutting tools wherein a bonding layer formed from elemental boron is interposed between the substrate and the outer wear resistant coating to increase adhesion between the layers and improve the abrasion resistance of the tool.

It is a further object of the subject invention to provide a new and improved multi-layered hard metal body for use in cutting tools wherein an additional intermediate layer is disposed between the substrate and the boron bonding layer for further enhancing the abrasion resistance of the tool.

SUMMARY OF THE INVENTION

In accordance with these and many other objects, the subject invention provides for a multi-layered hard metal body adapted for use in a cutting tool. The hard metal body includes a substrate formed from a cemented carbide material, specifically a combination of tungsten carbide and cobalt. A bonding layer having a thickness of approximately 1 to 15 microns, is deposited over the substrate and consists of elemental boron. An outer wear resistant coating of titanium boride may then be deposited over the boron bonding layer to achieve a multi-layered structure with improved adhesion characteristics.

In an alternate embodiment of the subject invention, an intermediate layer may be provided which is interposed between the boron bonding layer and the substrate. The intermediate layer preferably consists of a relatively thin layer of titanium carbide, titanium nitride, titanium carbonitride, hafnium carbide, hafnium nitride, hafnium carbonitride, zirconium carbide, zirconium nitride, zirconium carbonitride, or a mixture of any of the foregoing which is deposited on the substrate prior to the formation of the elemental boron bonding layer. The inclusion of such an intermediate layer functions to arrest diffusion of the boron from the boron bonding layer to the substrate.

Further objects and advantages of the subject invention will become apparent from the following detailed description of the preferred embodiments.

DETAILED DESCRIPTION OF THE PREFERRED EMBODIMENTS

In accordance with the above stated objects, the subject invention provides for a multi-layered hard metal body adapted for use in cutting tools. The subject cutting tools are highly abrasion resistant and are useful in metal cutting and rock drilling applications. The hard metal body includes a cemented and sintered metal carbide substrate with an outer wear resistant layer. At least one intermediate layer is provided to increase the adhesion between the substrate and the outer coating.

In the production of the first embodiment of the subject invention, a substrate is provided consisting of a tungsten carbide and cobalt composition. In order to enhance the adhesion characteristics of the article an intermediate bonding layer, consisting of elemental boron is vapor-deposited on the substrate. Preferably, the boron bonding layer is between 1 and 15 microns thick, thereby minimizing the heavy layer of porosity that resulted when a material is merely diffused into the substrate surface as provided in the prior art. Thereafter, an outer coating of a wear resistant material consisting of titanium boride is vapor-deposited over the bonding layer of boron. Preferably, the titanium boride layer is between 3 and 20 microns thick. As illustrated in the Table printed and discussed below, the adhesion between the layers is significantly enhanced in a cutting tool formed in accordance with the subject method.

In an alternate embodiment of the subject invention, diffusion of boron from the boron bonding layer into the substrate may be arrested by interposing an intermediate layer between the substrate and the bonding layer of elemental boron. More specifically, prior to the deposition of the boron bonding layer, a relatively thin intermediate layer of titanium carbide, titanium nitride, titanium carbonitride, hafnium carbide, hafnium nitride, hafnium carbonitride, zirconium carbide, zirconium nitride, zirconium carbonitride, or a mixture of any of the foregoing and more preferably a layer of titanium carbide, titanium nitride, titanium carbonitride, or any of the foregoing may be vapor-deposited directly on the cemented carbide substrate. Preferably, the thickness of this intermediate layer is on the order of 1 micron.

Hard metal bodies formed in accordance with the subject invention were compared with cutting tools having titanium boride coatings, as applied by the prior art methods. Initially, the hard metal bodies were subjected to a diamond scratch test which consisted of pulling a Rockwell A diamond hardness indenter, which was loaded with four kilogram weight, across the titanium boride coatings. Adherency of the outer coating is judged by determining the amount of coating which spalls off along the scratch mark. Microscopic examinations were made under 200 power magnification. Under these conditions, some spalling off was observed on the cutting tools formed by the prior art methods whereas no spalling occurred on the samples coated in accordance with the subject invention.

The hard metal bodies were also subjected to a sandstone cutting test to determine abrasion resistance. In the latter test, the results listed below in Table I, the hard metal bodies were subjected to abrasive forces, in a manner such that the amount of weight loss during the test is inversely proportional to the abrasion resistance of the tool. In the test, a standard cutting insert substrate was utilized having a 84% tungsten carbide and 16% cobalt composition. The results demonstrate that an insert coated in accordance with the prior art method has about twice the abrasion resistance of an uncoated insert. However, a hard metal body coated in accordance with the first embodiment of the subject invention, wherein a layer of elemental boron is vapor-deposited between the substrate and the outer coating, results in a greater than eight fold increase in abrasion resistance. Further, a hard metal body coated in accordance with the second embodiment of the subject invention, wherein a thin intermediate layer of titanium carbide is interposed between the substrate and the boron bonding layer, produces approximately an 11 fold increase in abrasion resistance.

TABLE I

| SAMPLE | WEIGHT LOSS DURING TEST | IMPROVEMENT RATIO |
|---|---|---|
| Uncoated - (Tungsten carbide and cobalt) | .1402 | — |
| Coated with titanium Boride (Prior art method) | .0621 | 2.2 |
| Coated with titanium boride including boron bonding layer (first embodiment) | .0164 | 8.5 |
| Coated with titanium boride including intermediate titanium carbide and boron bonding layers (second embodiment) | .0128 | 11.0 |

In summary, there is provided a new and improved hard metal body and a method for forming the same adapted for use in cutting tools. More particularly, a multi-layered wear resistant article is provided having a substrate formed from a tungsten carbide and cobalt composition. A bonding layer is disposed over the substrate and consists of elemental boron. A wear resistant outer coating is provided over the boron bonding layer which is formed from titanium boride. The bonding layer of elemental boron functions to both increase the adhesion between the layers and enhances the abrasion resistance of the tool. A layer of titanium carbide, titanium nitride, titanium carbonitride, hafnium carbide, hafnium nitride, hafnium carbonitride, zirconium carbide, zirconium nitride, zirconium carbonitride, or a mixture of any of the foregoing can be interposed between the substrate and the boron adhesive layer to prevent diffusion of the boron from the adhesive layer to the substrate.

The above mentioned patents and/or publications are incorporated herein by reference. Obviously, other modifications and variations of the present invention are possible in light of the above teachings. It is therefore to be understood that changes may be made in the particular embodiments of the invention described which are within the full intended scope of the invention as defined by the appended claims.

I claim:

1. An article with improved bond strength comprising:

a substrate formed from a cemented sintered metal carbide material;

a bonding layer disposed over said substrate, said bonding layer being formed from boron; and a wear resistant outer coating disposed over said bonding layer, said outer coating being formed from titanium boride.

2. An article as recited in claim 1 wherein said boron bonding layer is between 1 and 15 microns thick.

3. An article as recited in claim 2 wherein said titanium boride coating is between 3 and 20 microns thick.

4. An article as recited in claim 1 further including an intermediate layer, said intermediate layer being interposed between said substrate and said bonding layer.

5. An article as recited in claim 4 wherein said intermediate layer is formed from titanium carbide, titanium nitride, titanium carbonitride, hafnium carbide, hafnium nitride, hafnium carbonitride, zirconium carbide, zirconium nitride, zirconium carbonitride, or a mixture of any of the foregoing.

6. An article as recited in claim 5 wherein said intermediate layer is formed from titanium carbide, titanium nitride, titanium carbonitride, or a mixture of any of the foregoing.

7. An article as recited in claim 5 wherein said intermediate layer is about 1 micron thick.

8. An article as recited in claim 1 wherein said substrate is formed from a tungsten carbide and cobalt composition.

* * * * *